US007159403B2

(12) United States Patent
Kastrup et al.

(10) Patent No.: US 7,159,403 B2
(45) Date of Patent: Jan. 9, 2007

(54) APPARATUS FOR ASSEMBLING GAS TURBINE ENGINE COMBUSTORS

(75) Inventors: David Allen Kastrup, West Chester, OH (US); Stephen Charles Furbish, Saugus, MA (US)

(73) Assignee: General Electric Company, Schenectady, NY (US)

( * ) Notice: Subject to any disclaimer, the term of this patent is extended or adjusted under 35 U.S.C. 154(b) by 46 days.

(21) Appl. No.: 10/673,875

(22) Filed: Sep. 29, 2003

(65) Prior Publication Data

US 2005/0015984 A1 Jan. 27, 2005

Related U.S. Application Data

(62) Division of application No. 10/046,844, filed on Jan. 15, 2002, now Pat. No. 6,655,027.

(51) Int. Cl.
*F23R 3/50* (2006.01)
*F23R 3/14* (2006.01)

(52) U.S. Cl. ..... 60/798; 60/747; 60/748

(58) Field of Classification Search ..... 60/746, 60/747, 748, 798; 29/888–889
See application file for complete search history.

(56) References Cited

U.S. PATENT DOCUMENTS 5,239,832 A * 8/1993 Koshoffer et al. ..... 60/740
5,353,587 A * 10/1994 Halila ..... 60/39.37
5,524,430 A * 6/1996 Mazeaud et al. ..... 60/798
6,164,074 A * 12/2000 Madden et al. ..... 60/750
6,212,870 B1 * 4/2001 Thompson et al. ..... 60/746
6,502,400 B1 * 1/2003 Freidauer et al. ..... 60/748
6,655,027 B1 * 12/2003 Kastrup et al. ..... 29/890.01

FOREIGN PATENT DOCUMENTS

WO WO 0190652 A1 * 3/2001

* cited by examiner

*Primary Examiner*—Ted Kim
(74) *Attorney, Agent, or Firm*—William Scott Andes; Armstrong Teasdale LLP

(57) ABSTRACT

A method for assembling a gas turbine engine combustor facilitates reducing costs and time required for assembly. The combustor includes a spectacle plate, a plurality of swirlers, and a plurality of deflector plates. The method includes coupling an assembly fixture to at least one swirler, coupling the assembly fixture to the spectacle plate such that the swirler is maintained in alignment with respect to the spectacle plate during assembly of the combustor, and attaching the swirler to the spectacle plate.

5 Claims, 4 Drawing Sheets

APPARATUS FOR ASSEMBLING GAS TURBINE ENGINE COMBUSTORS

This application is a divisional of U.S. application Ser. No. 10/046,844, filed Jan. 15, 2002, now U.S. Pat. No. 6,655,027, which is hereby incorporated by reference.

BACKGROUND OF THE INVENTION

This invention relates generally to gas turbine engine combustors and more particularly, to methods and apparatus for assembling gas turbine engine combustors.

Gas turbine engines include combustors which ignite fuel-air mixtures. At least some known combustors include annular dome assemblies which support a plurality of other combustor components. For example, dome assembly spectacle plates enable premixers to mate with downstream swirlers. Aligning the swirlers with respect to the premixers may be a complex task since the design tolerances of the premixers typically require more radial tolerance than circumferential tolerance. In addition, variations in the machined surfaces of the combustor components may further complicate the alignment process.

To facilitate aligning the swirlers with respect to the spectacle plate, at least some known swirlers include a locating pin that mates with a notch that is machined into the spectacle plate. More specifically, the locating pin and mating notch facilitate aligning or clocking the swirlers in such a manner to ensure radial movement of the premixers is permitted. In addition, the alignment of the swirlers directly influences the alignment of deflector plates that are coupled to the spectacle plate around the swirlers. More specifically, the locating pins facilitate the deflector plates being aligned with respect to the spectacle plate such that a pre-determined clearance is defined between adjacent deflector plates during the cold-assembled state.

The alignment of the deflector plates during the cold-assembled state directly affects the clearances between the deflectors at operating temperatures, and thus, may affect the useful life of the combustor. However, despite the use of the locating pins, variations in the machined features of the deflector plates and in the mating hardware, may still cause undesirable clearance variations between adjacent deflector plates. In addition, manufacturing the swirlers to include the pins increases the costs in comparison to those swirlers which do not include the locating pins. Furthermore, over time continued operation of a combustor with undesirable clearances may damage combustor components.

BRIEF SUMMARY OF THE INVENTION

In one aspect, a method for assembling a gas turbine engine combustor is provided. The combustor includes a spectacle plate, a plurality of swirlers, and a plurality of deflector plates. The method includes coupling an assembly fixture to at least one swirler, coupling the assembly fixture to the spectacle plate such that the swirler is maintained in alignment with respect to the spectacle plate during assembly of the combustor, and attaching the swirler to the spectacle plate.

In another aspect, a combustor for a gas turbine engine is provided. The combustor includes a spectacle plate, and a plurality of swirlers attached to the spectacle plate. Assembling the combustor comprises coupling an assembly fixture to at least one said swirler, removably coupling each respective assembly fixture to the spectacle plate to maintain an alignment of each said respective swirler with respect to said spectacle plate, and uncoupling each respective assembly from said spectacle plate after each said swirler is attached to said spectacle plate.

In a further aspect, an assembly fixture for a gas turbine engine combustor including a spectacle plate is provided. The assembly fixture is removably coupled to the spectacle plate during assembly of the combustor for aligning at least one of a plurality of swirlers and a plurality of deflector plates for attachment to the spectacle plate.

DETAILED DESCRIPTION OF THE INVENTION

Figure 1:
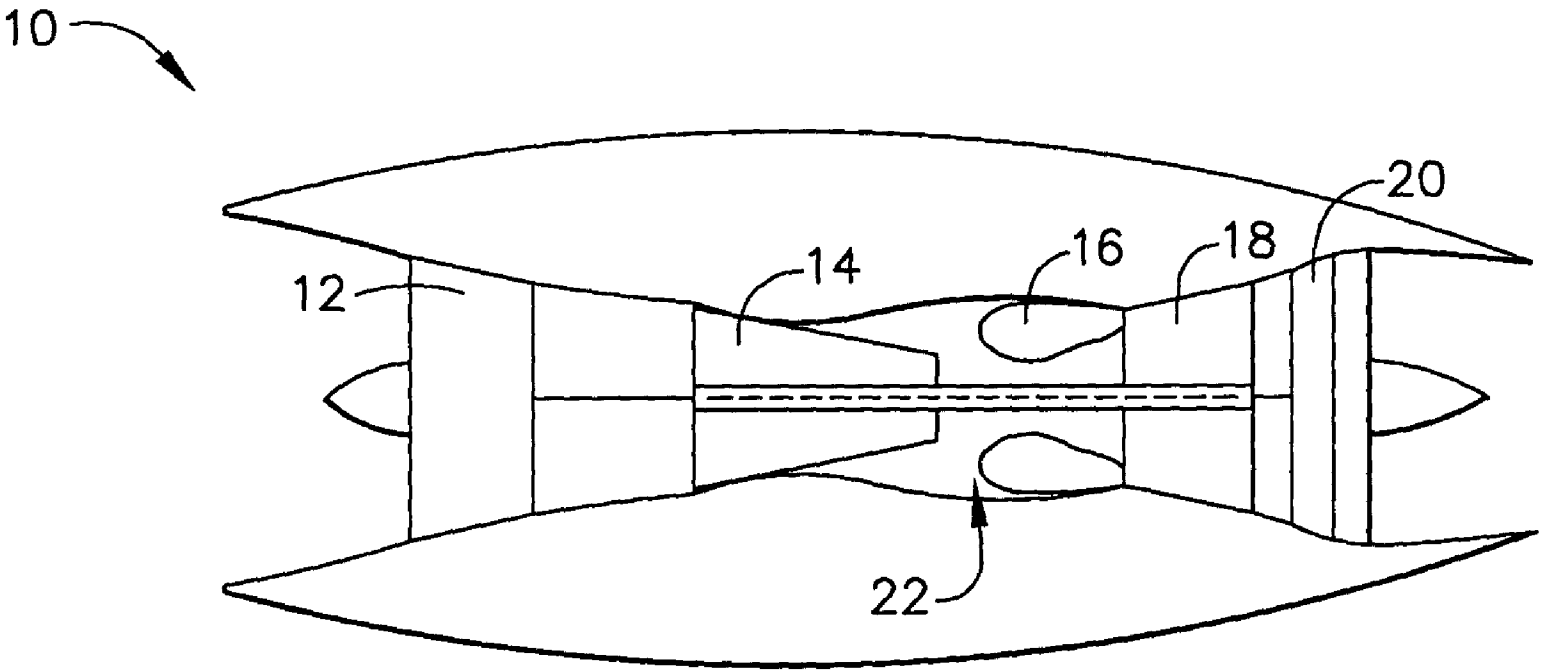
FIG. 1 is a schematic illustration of a gas turbine engine.

FIG. 1 is a schematic illustration of a gas turbine engine 10 including a low pressure compressor 12, a high pressure compressor 14, and a combustor 16. Engine 10 also includes a high pressure turbine 18 and a low pressure turbine 20. Combustor 16 includes an upstream side 22, and at least one dome (not shown). In one embodiment, the gas turbine engine is a GE-90 engine commercially available from General Electric Company, Cincinnati, Ohio.

In operation, air flows through low pressure compressor 12 and compressed air is supplied from low pressure compressor 12 to high pressure compressor 14. The highly compressed air is delivered to combustor 16. Airflow (not shown in FIG. 1) from combustor 16 drives turbines 18 and 20.

Figure 2:
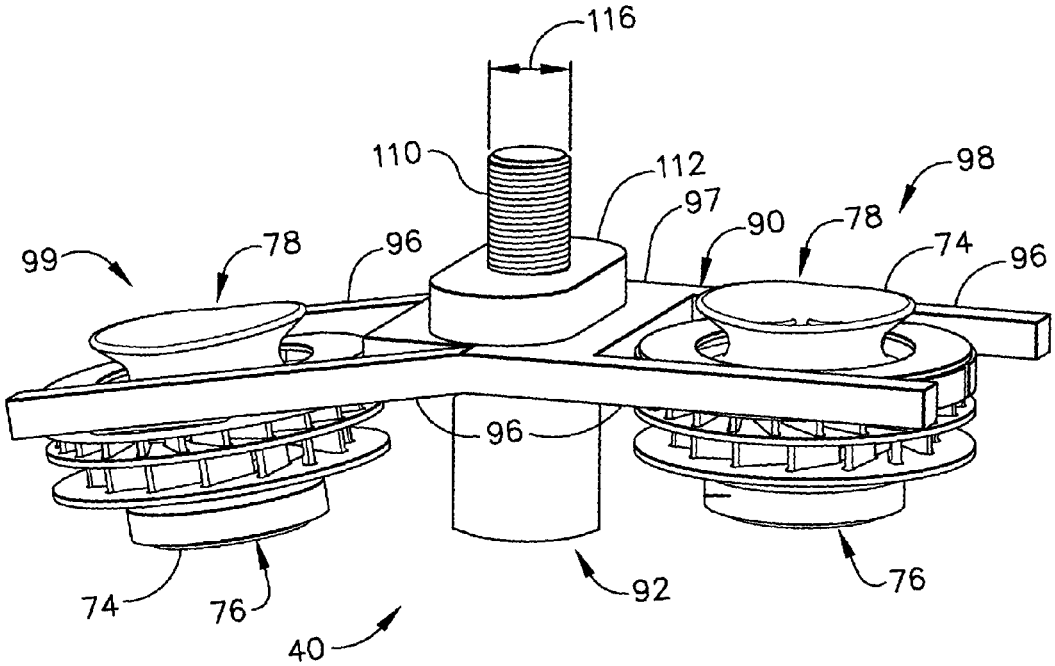
FIG. 2 is side perspective view of an assembly fixture that may be used during assembly of the engine shown in FIG. 1.
Figure 3:
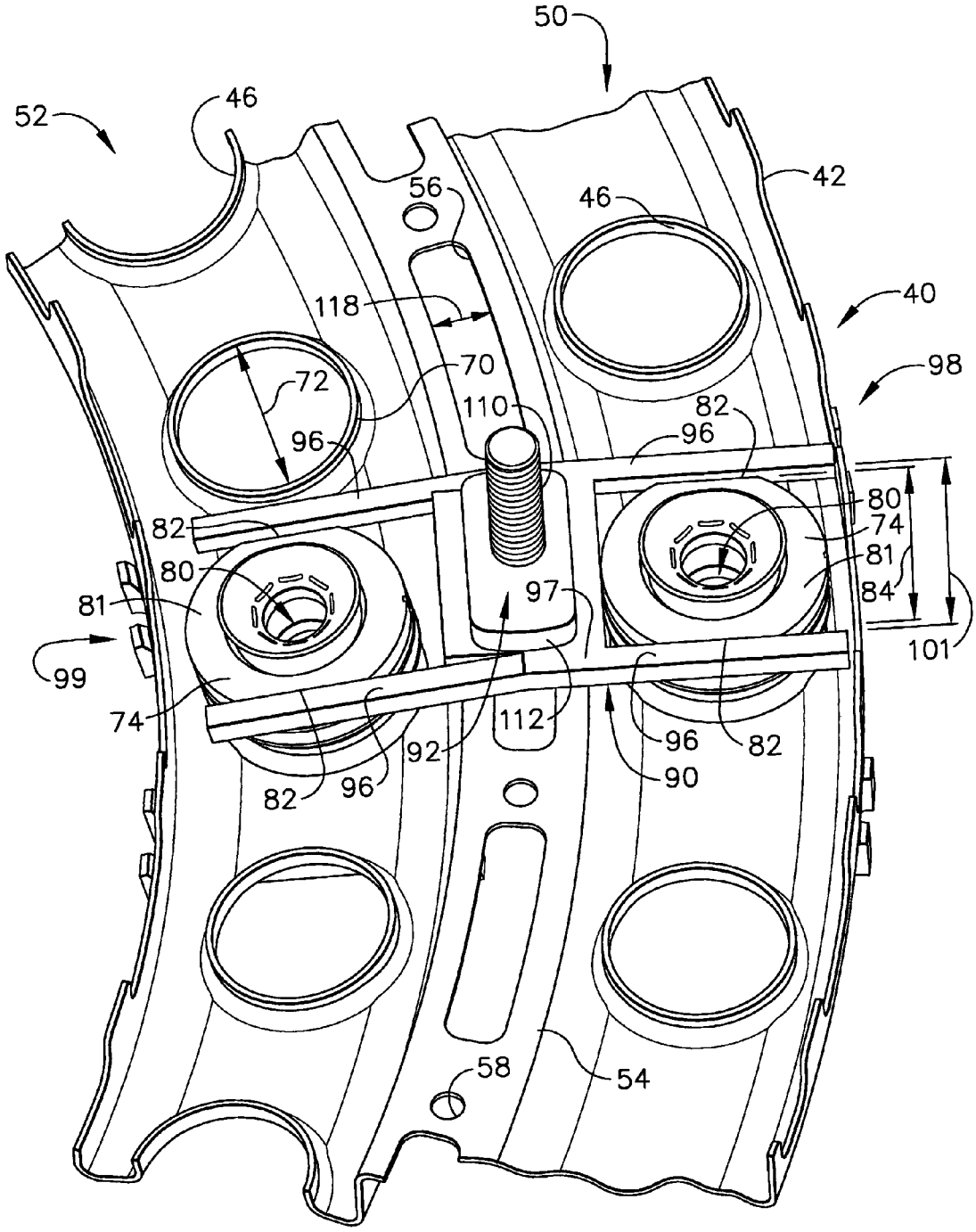
FIG. 3 is a side perspective view of the assembly fixture shown in FIG. 2 and coupled to a combustor spectacle plate.

FIG. 2 is side perspective view of an assembly fixture 40 that may be used during assembly of a gas turbine engine combustor, such as combustor 16 (shown in FIG. 1). FIG. 3 is a side perspective view of assembly fixture 40 coupled to a combustor spectacle plate 42. In the exemplary embodiment, combustor 16 is a dual annular combustor. Combustor spectacle plate 42 is generally annular and includes a plurality of openings 46 positioned circumferentially through spectacle plate 42. In one embodiment, spectacle plate 42 is a die formed sheet metal part. More specifically, in the exemplary embodiment, openings 46 are spaced circumferentially in two rows 50 and 52. Rows 50 and 52 are known respectively, as an inner and outer annulus, and are separated by a raised flange portion 54 that includes a plurality of alternating slotted openings 56 and substantially circular openings 58.

Each spectacle plate opening 46 is substantially circular and is defined by a raised flange 70. Each raised flange 70 has an inner diameter 72 that is sized to receive a portion of a swirler 74 therein, and a mating premixer (not shown). Swirlers 74 are known in the art are utilized to facilitate swirling incoming air to enhance flame stabilization and mixing downstream from swirlers 74. Swirlers 74 include an inlet side 76, an outlet side 78, and an opening 80 extending therebetween. Swirlers 74 also include an outer flange 81 that is substantially circular and includes a pair of flats 82. Flats 82 are substantially parallel, diametrically opposed, and a distance 84 apart.

Assembly fixture 40 includes a bar clamp portion 90 and an attachment portion 92. Bar clamp portion 90 is substantially H-shaped and includes a plurality of arms 96 extending radially outward from a center brace 97. More specifically, arms 96 are arranged in pairs 98 and 99. Within respective pairs 98 and 99, arms 96 are substantially parallel and are separated by a distance 101 that is slightly larger than swirler flat distance 84. Accordingly, arms 96 are sized to receive swirlers 74 therebetween such that swirler flats 82 remain in contact with clamp portion arms 96 while swirler 74 is held therebetween.

Bar clamp portion center brace 97 extends between pairs of arms 98 and 99, and includes an opening (not shown) that extends therethrough. More specifically, center brace 97 is substantially perpendicular to arms 96. The center brace opening is substantially circular and is sized to receive a threaded portion 110 of attachment portion 92 therethrough. Attachment portion 92 also includes a bar clamp 112 that includes a threaded opening (not shown) that enables bar clamp 112 to threadingly couple to threaded portion 110. Threaded portion 110 has a diameter 116 that is less than a width 118 of slotted opening 56.

During assembly of combustor 16, a pair of swirlers 74 are coupled within respective bar clamp arm pairs 98 and 99. More specifically, when swirlers 74 are coupled to assembly fixture 40, each respective swirler flat 82 is in frictional contact with a respective arm 96, such that swirler 74 is tightly held between parallel arms 96. Assembly fixture 40 is then positioned adjacent to spectacle plate 42 such that each respective swirler 74 coupled to assembly fixture 40 is substantially aligned with respect to spectacle plate 42. Specifically, assembly fixture 40 enables each swirler 74 to be aligned substantially concentrically with respect to a respective spectacle plate opening 46.

After each swirler 74 is aligned with respect to spectacle plate 42, assembly fixture attachment portion 92 couples assembly fixture 40, including swirlers 74, to spectacle plate 42, such that the alignment between swirlers 74 and respective openings 46 is maintained during assembly of combustor 16. More specifically, after assembly fixture 40 is positioned adjacent spectacle plate 42, attachment threaded portion 110 is inserted from an upstream side of spectacle plate 42 through a slotted opening 56 and through bar clamp portion center brace 97. Bar clamp 112 is then threadingly coupled to portion 110 and tightened against clamp portion 90 to maintain assembly fixture 40 in alignment with respect to spectacle plate 42. Swirlers 74 are then coupled to spectacle plate 42. In the exemplary embodiment, swirlers 74 are tack-welded to spectacle plate 42. Alternatively, swirlers 74 are brazed to spectacle plate 42.

After swirlers 74 are secured to spectacle plate 42, assembly fixture attachment portion 92 is loosened to enable assembly fixture 40 to be removed from spectacle plate 42. As a result, swirlers 74 are maintained in alignment with respect to spectacle plate 42 in a cost effective and highly reliable manner. Moreover, assembly fixture 40 enables swirlers 74 to have greater radial movement than circumferential movement to facilitate aligning the premixers with respect to swirlers 74. Furthermore, assembly fixture 40 enables swirlers 74 to be fabricated without locating pins (not shown). As a result, overall assembly time and manufacturing costs of combustor 16 are facilitated to be reduced.

Figure 4:
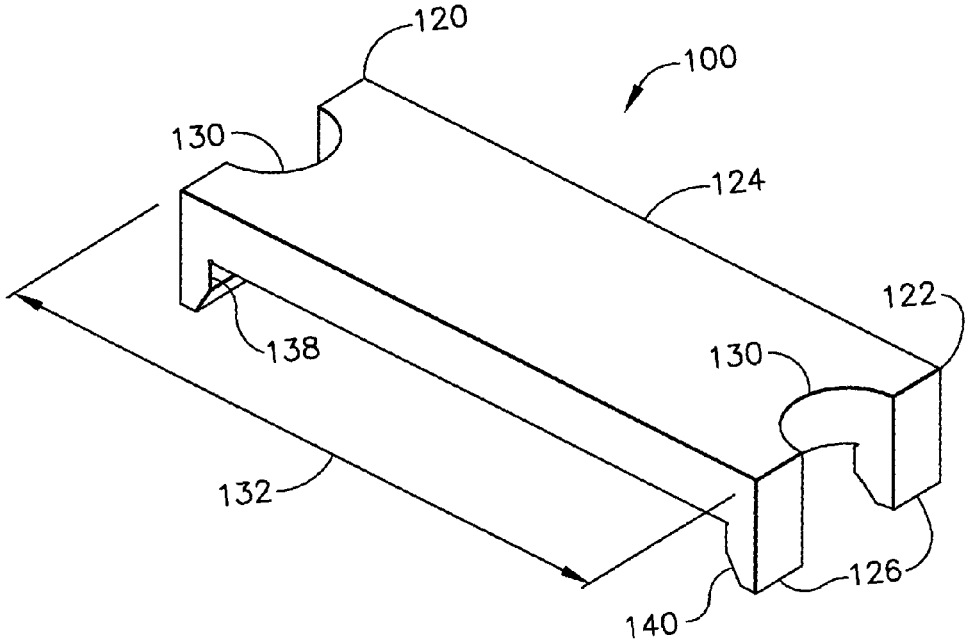
FIG. 4 is a perspective view of an alignment fixture that may be used during assembly of the engine shown in FIG. 1.
Figure 5:
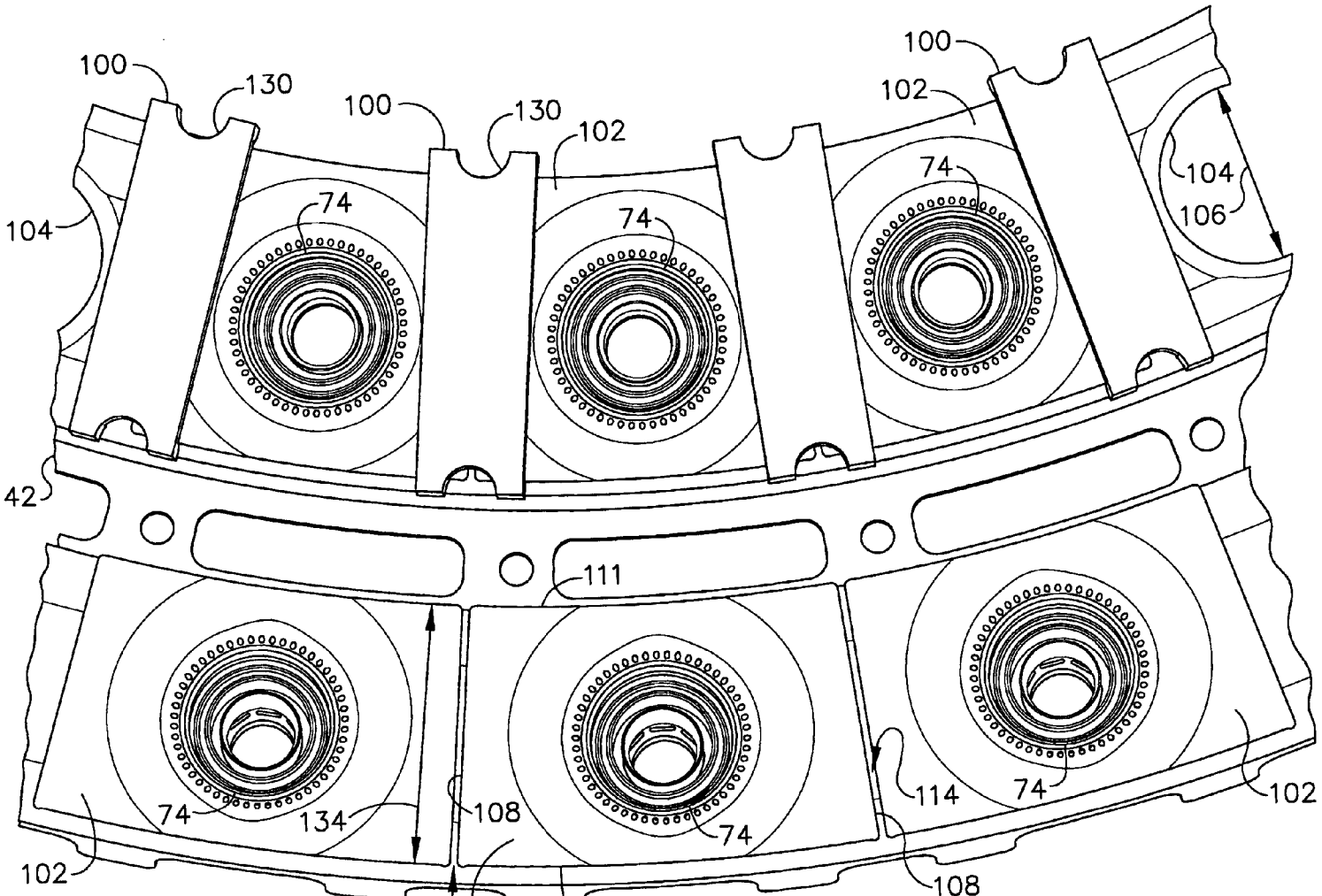
FIG. 5 is plan view of the alignment fixture shown in FIG. 4 and attached to combustor spectacle plate.

FIG. 4 is a perspective view of an alignment fixture 100 that may be used during assembly of a gas turbine engine combustor, such as combustor 16 (shown in FIG. 1). FIG. 5 is a plan view of alignment fixture 100 attached to combustor spectacle plate 42. After swirlers 74 are secured to spectacle plate 42, as described above, a plurality of deflector plates 102 are then secured to spectacle plate 42. Each deflector plate 102 includes a center opening 104 that has a diameter 106, a pair of opposing circumferential edges 108, and a pair of opposing radial edges 111. Center opening diameter 106 is sized to receive at least a portion of a respective swirler 74 therein. More specifically, center opening 104 enables each respective deflector plate 102 to be positioned adjacent spectacle plate 42 when swirlers 74 are attached such that a clearance 114 is defined between adjacent deflector plates 102.

Alignment fixtures 100 are utilized during assembly to facilitate maintaining a pre-determined clearance 114 between adjacent deflector plates 102. Each alignment fixture 100 includes a first end 120, a second end 122, and a body portion 124 that extends therebetween. Ends 120 and 122 are identical, and each includes a pair of arms 126 that extend substantially perpendicularly from body portion 124. A curved radius 130 extends through body portion 124 between parallel arms 126. In one embodiment, alignment fixture 100 is fabricated from a material that has a lower coefficient of thermal expansion than that of a material used to fabricate deflector plates 102.

Alignment fixture 100 has a length 132 measured between arms 126 at opposite ends 120 and 122 that is larger than a height 134 of each respective deflector plate 102 measured with respect to radial edges 111. Accordingly, fixture length 132 enables fixture 100 to be "clipped" over a respective deflector plate 102 such that deflector plate radial edges 111 are adjacent an inner surface 138 of each pair of arms 126. To facilitate deflector plates 102 being received within arms 126, an end 140 of each respective arm is chamfered.

During assembly of combustor 16, after swirlers 74 are secured to spectacle plate 42, as described above, a plurality of deflector plates 102 are positioned adjacent spectacle plate 42. More specifically, deflector plates 102 are positioned adjacent spectacle plate 42 such that each respective swirler is received within each deflector plate center opening 104, and such that circumferential edges 108 between adjacent deflector plates 102 define clearance 114.

After at least a pair of deflector plates 102 have been positioned adjacent spectacle plate 42, an alignment fixture 100 is coupled to a respective pair of deflector plates 102. More specifically, alignment fixture 100 is coupled to adjacent deflector plates 102 and extends over clearance 114. Alignment fixtures maintain alignment of deflector plates relative to spectacle plate 42 such that clearance 114 is maintained, and such that each respective deflector plate 102 is aligned substantially concentrically with each respective swirler 74.

After alignment fixtures 100 have been coupled between each respective pair of adjacent deflector plates 102, deflector plates 102 are secured to spectacle plate 42. More specifically, in the exemplary embodiment, spectacle plate 42 is heated in a braze furnace to secure deflector plates 102 to spectacle plate 42. Because deflector plates 102 are fabricated from a material which has a larger coefficient of thermal expansion, deflector plates 102 thermally expand more than fixtures 100. At braze temperature, deflector plates 102 are thermally locked into fixtures 100, thus providing a self-alignment feature. As spectacle plate 42 is cooled, braze alloy solidifies, fixtures 100 are removed, and deflector plates 102 are maintained in alignment prior to any movement or handling of the assembly. As a result, deflector plates 102 are aligned in a cost-effective and highly reliable manner. Furthermore, fixtures 100 enable deflector plates 102 to be fabricated without locating grooves (not shown). As a result, overall assembly time and manufacturing costs of combustor 16 are facilitated to be reduced.

The above-described assembly fixtures enable a combustor to be assembled in a cost-effective and reliable manner. During assembly, the assembly fixtures temporarily coupled to the combustor spectacle plate to initially maintain the alignment of swirlers with respect to the spectacle plate, and subsequently, maintain the alignment of deflector plates with respect to the spectacle plate. Moreover, such assembly fixtures are not limited to use during the initial assembly of combustors, but also facilitate repair and/or retrofit of combustors. Thus, assembly fixtures are provided, which facilitate the assembly of combustors in a cost-effective and reliable manner.

While the invention has been described in terms of various specific embodiments, those skilled in the art will recognize that the invention can be practiced with modification within the spirit and scope of the claims.

What is claimed is:

1. A dual annular combustor for a gas turbine engine, said combustor comprising a spectacle plate comprising an inner annulus and an outer annulus, and a plurality of pairs of swirlers attached to said spectacle plate, each of said pair of swirlers comprises an inner swirler coupled to said inner annulus and an outer swirler coupled to said outer annulus, each said swirler comprising a pair of substantially parallel flats, wherein to assemble said combustor:

an assembly fixture is coupled to one pair of said swirlers, wherein said assembly fixture includes a plurality of arms that are sized to receive and align said flats of each said swirler with respect to each other and an attachment portion that is configured to couple to said spectacle plate;

said assembly fixture is removably coupled to said spectacle plate to facilitate maintaining an alignment of each said swirler with respect to said spectacle plate;

each remaining swirler is then coupled to said spectacle plate; and said assembly fixture is then uncoupled from said spectacle plate after each said swirler is attached to said spectacle plate.

2. A combustor in accordance with claim 1 further comprising a plurality of deflector plates comprising an opening extending therethrough, wherein to assemble said combustor, said plurality of deflector plates are each attached to said spectacle plate such that wherein each said deflector plate opening is substantially concentrically aligned with each respective said swirler.

3. A combustor in accordance with claim 2 wherein each said swirler is welded to said spectacle plate prior to uncoupling each respective assembly fixture.

4. A combustor in accordance with claim 2 wherein to assemble said combustor further comprises:

a first of said deflector plates is positioned against said spectacle plate;

a second of said deflector plates is positioned against said spectacle plate and circumferentially adjacent said first deflector plate; and an alignment fixture is removably coupled between said first and second deflector plates to maintain a position of said first and second deflector plates with respect to said spectacle plate.

5. A combustor in accordance with claim 4 wherein each said deflector plate is brazed to said spectacle plate, and wherein each respective alignment fixture is removed after said first and second deflector plates are secured to said spectacle plate during assembly of said combustor.

* * * * *